US008065756B2

(12) United States Patent
Yeung

(10) Patent No.: US 8,065,756 B2
(45) Date of Patent: Nov. 29, 2011

(54) TILTING-BOWL TOILETS

(76) Inventor: Shu-Ki Yeung, Saint Laurent (CA)

( * ) Notice: Subject to any disclaimer, the term of this patent is extended or adjusted under 35 U.S.C. 154(b) by 915 days.

(21) Appl. No.: 11/959,390

(22) Filed: Dec. 18, 2007

(65) Prior Publication Data

US 2009/0031487 A1 Feb. 5, 2009

(30) Foreign Application Priority Data

Jan. 3, 2007 (CA) ..... 2573220

(51) Int. Cl.
*E05D 11/10* (2006.01)

(52) U.S. Cl. ..... 4/434; 4/438; 4/440

(58) Field of Classification Search ..... 4/434, 436, 4/438, 439, 440, 441, 442
See application file for complete search history.

(56) References Cited

U.S. PATENT DOCUMENTS 3,251,068 A * 5/1966 Milette et al. ..... 4/323
3,566,418 A * 3/1971 Carlson et al. ..... 4/441
3,769,637 A * 11/1973 Llames ..... 4/436
3,798,681 A * 3/1974 Johansen ..... 4/440
3,883,903 A * 5/1975 Vanden Broek et al. ..... 4/440
3,939,500 A * 2/1976 Miller et al. ..... 4/332
3,949,431 A * 4/1976 Morgan ..... 4/440
4,142,261 A * 3/1979 Johansen ..... 4/300
4,155,129 A * 5/1979 Russell ..... 4/429
4,246,666 A * 1/1981 Stansbury, Jr. ..... 4/438
5,802,627 A * 9/1998 Yeung ..... 4/313
6,070,276 A * 6/2000 Yeung ..... 4/442
6,076,200 A * 6/2000 Yeung ..... 4/442
6,332,229 B1 * 12/2001 O'Malley et al. ..... 4/438
6,467,101 B1 * 10/2002 Artola ..... 4/354
6,772,450 B1 * 8/2004 Saylor et al. ..... 4/223
2006/0143815 A1 * 7/2006 Peres ..... 4/442

* cited by examiner

*Primary Examiner* — David Purol

(57) ABSTRACT

Tilting Bowl Toilet comprises a frame, a toilet basin, and a tilting bowl. The tilting bowl is supported below the toilet basin to receive and hold water/waste delivered from the toilet basin. The tilting bowl tilts to discharge its content to drainage. The tilting bowl at standby is sustained to stay in a horizontal position by forces applied to the tilting bowl creating a resultant sustaining turning moment about its support axis. When the turning moment produced by the tilting bowl with its content becomes larger than the sustaining turning moment, the tilting bowl moves to a tilted position to discharge its content. The effective support axis shifts with respect to the tilting bowl as guided by a motion guide.

20 Claims, 5 Drawing Sheets

FIG 4
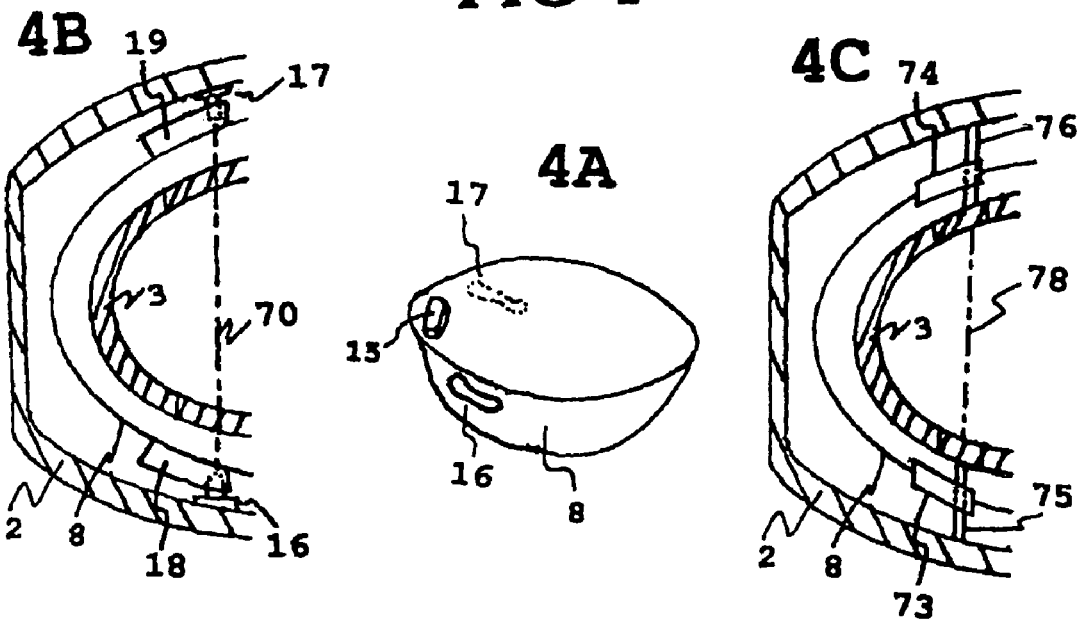
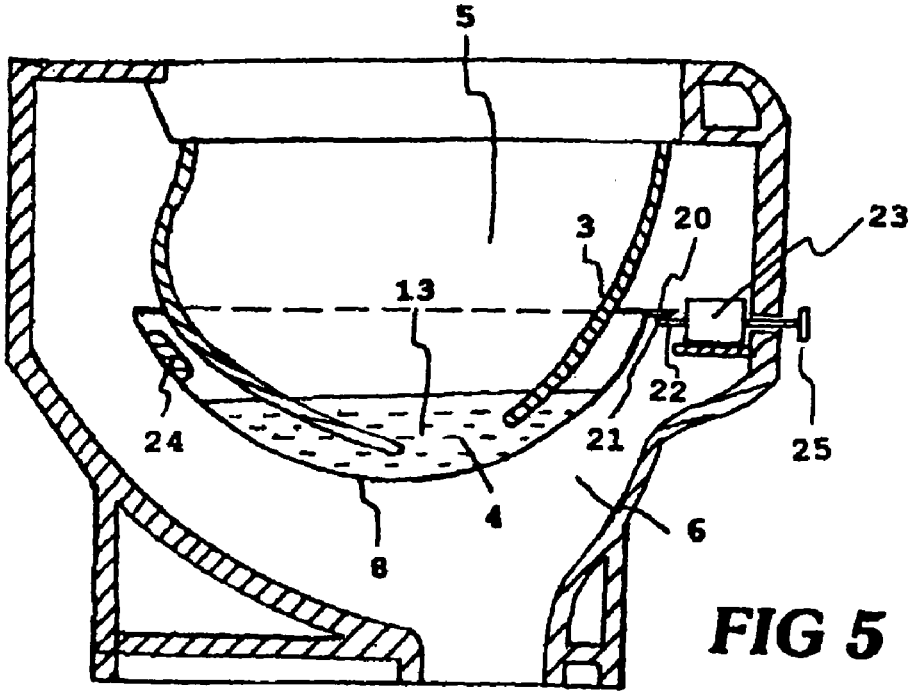
FIG 5

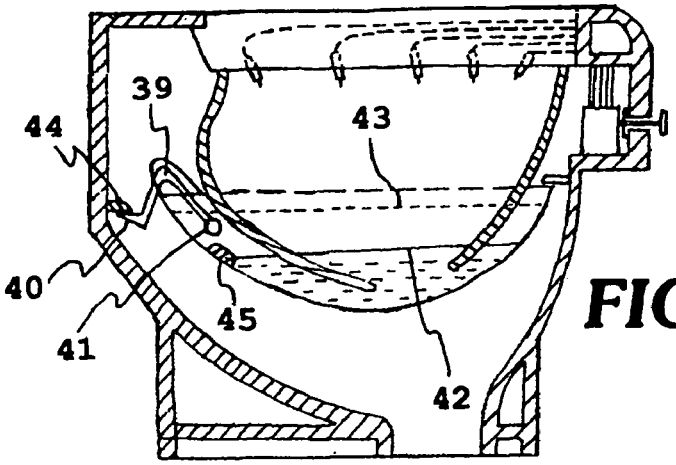
FIG 8
FIG 10
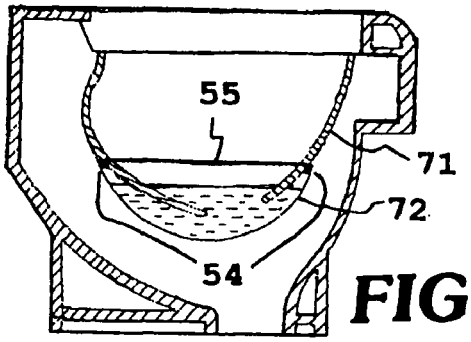
FIG 9
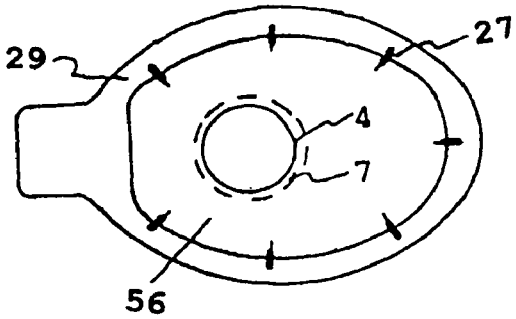
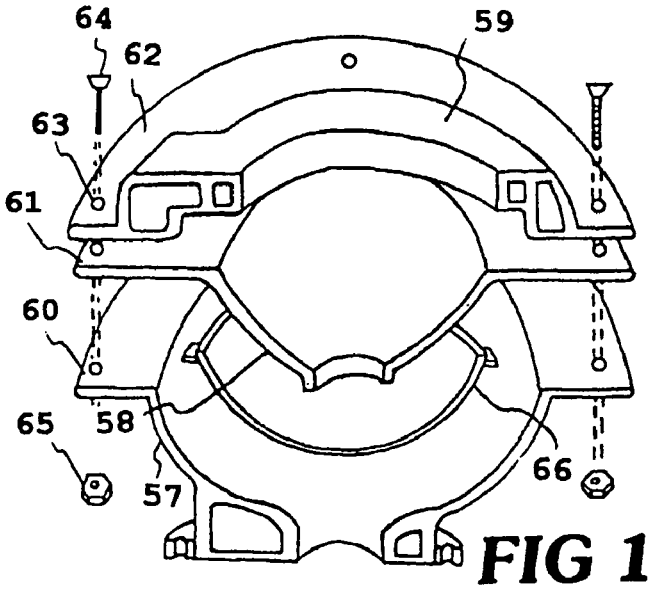
FIG 11
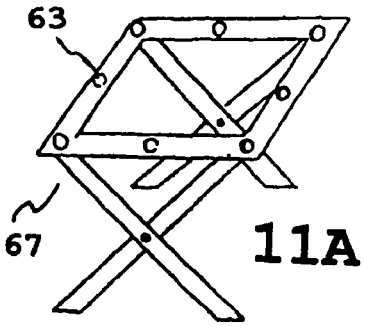
11A
11B
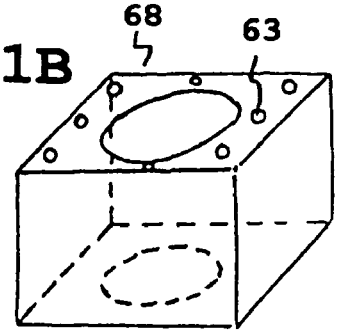

TILTING-BOWL TOILETS

BACKGROUND OF THE INVENTION

1. Field of the Invention

The present invention is a new version of tilting-bowl toilet that replaces siphon and zigzag water trap in tank toilets with a tilting bowl, thus annihilating most deficiencies associated with traditional tank toilets, including siphon noise and blocking. With optional sequential water ejection, optimum cleaning can be easily achieved even from low water pressure, resulting in significant saving of water and elimination of water tank.

2. Brief Description of Prior Arts

Major drawbacks of conventional toilets include necessity for a water tank or water pump to create high-pressured water to force water and waste through a zigzag water trap by siphon action, thus consuming big volume of water and making big siphon noise. Low-flow toilets available are often complained about high noise and insufficient cleaning, often necessitating double-flushing.

Other prior arts include those with a small flappable stopper at discharge hole or hand-driven through complicated mechanism, are generally only used as vehicle toilets.

Applicant's inventions of Tilting-bowl toilets have been granted U.S. Pat. Nos. 5,802,627 and 6,070,276 and 6,076,200. With improved tilting bowl movement, this new version further improves operation efficiency and minimizes toilet size.

SUMMARY OF THE INVENTION

According to a broad aspect of the present invention, there is provided a toilet comprising:

a frame defining a chamber, a toilet basin associated with said frame to define said chamber into an upper chamber region and a lower chamber region, said toilet basin defining at least one basin discharge opening in communication between said upper chamber region and said lower chamber region, a tilting bowl disposed generally in said lower chamber region, said tilting bowl defining a fluid-receiving volume, said tilting bowl supported for movement relative to said toilet basin between a substantially horizontal first position to receive and hold fluid communicated through said at least one basin discharge opening, and a second position permitting flow of fluid from said toilet basin, through said at least one basin discharge opening, and from said fluid-receiving volume into said lower chamber region, characterized in that said tilting bowl is sustained to remain in said first position by the resultant of forces applied to said tilting bowl, said resultant of forces producing a sustaining turning moment about the effective support axis at least sufficient to counterbalance the turning moment produced by said tilting bowl with its content, said tilting bowl moves from said first position toward said second position when said sustaining turning moment is smaller than said turning moment produced by said tilting bowl with its content, said tilting bowl movement is guided by at least one prescribed motion guide.

In accordance with preferred embodiments of the toilet according to the present invention:

the toilet further comprises triggering means to reduce said sustaining turning moment to start toilet operation.

the toilet further comprises means to actuate said tilting bowl movement at predetermined fluid level of said fluid receiving volume.

said fluid-receiving volume, in said first position, at least partially overlaps said toilet basin, and retains a volume of fluid sufficient to engage said at least one basin discharge opening in a manner to restrict flow of gas therethrough;

said tilting bowl in said first position constitutes an impervious joint with said toilet basin to restrict gas in said lower chamber region from entering said fluid-receiving volume;

the toilet further comprises means to restrict sewage gas from entering said lower chamber region;

the toilet further comprises means for delivering water through a plurality of outlets disposed and arrayed to direct water in predetermined ejection order against said toilet basin for cleaning action;

the toilet further comprises means for maintaining a predetermined fluid level in said fluid-receiving volume, with said tilting bowl disposed in said first position, said level maintaining means triggering delivery of water when a fluid level below said predetermined fluid level is detected and stopping delivery of water when a fluid level at least equal to said predetermined fluid level is detected;

the toilet further comprises means to discharge excessive fluid when fluid level in said fluid-receiving volume exceeds a prescribed level;

delivery of water to said plurality of outlets and movement of said tilting bowl from said first position toward said second position are actuated simultaneously after toilet is triggered to operate;

delivery of water to said plurality of outlets and movement of said tilting bowl from said first position toward said second position are actuated at different time intervals after toilet is triggered to operate;

the toilet further comprises means to disable triggering when said tilting bowl and/or water delivery is operating;

said means to disable triggering is controlled by fluid level in said fluid-receiving volume;

the toilet is adapted for manual triggering, and/or electronic triggering, and/or remote triggering, and/or automatic triggering in response to departure of user;

said forces applied to said tilting bowl comprise constituents of gravity force and/or magnetic force and/or pneumatic force and/or hydraulic force and/or spring force and/or electrical force and/or electromagnetic force;

said tilting bowl, is biased to return from said second position toward said first position;

the toilet further comprises retard means to retard said tilting bowl from returning from said second position toward said first position;

said at least one basin discharge opening is disposed generally above a bottom discharge hole and with a vertical projection view at least partially overlapping a vertical projection view of said bottom discharge hole;

said plurality of outlets are arrayed to define an enclosure region disposed generally above said at least one basin discharge opening, said enclosure region casting a vertical projection view at least partially overlapping a vertical projection view of said at least one basin discharge opening and/or at least partially overlapping a vertical projection view of said bottom discharge hole;

the toilet in separate parts comprises separate and/or foldable frame, separate and/or foldable toilet basin, separate and/or foldable tilting bowl, separate and/or foldable water storage container, and/or separate and/or foldable waste container;

The objects, advantages and unique features of present invention will be illustrated and explained by the following non-restrictive description of preferred embodiments thereof, given by way of example only with reference to the accompanying drawings.

BRIEF DESCRIPTION OF THE DRAWING

In the appended drawings

FIG. 4 shows how the tilting bowl is supported to studs on toilet frame. The grooves serve to guide bowl movement;

FIG. 5 is a cross-sectional view of a preferred embodiment with switch to trigger tilting bowl movement;

FIG. 8 is a cross-sectional view of a preferred embodiment of the toilet wherein tilting bowl movement is triggered with respect to a predetermined fluid level;

FIG. 9 is a cross-sectional view of a preferred embodiment of the toilet showing a dry gas seal between tilting bow and toilet basin;

FIG. 10 is a top view of a preferred embodiment of the toilet showing preferred locations of array of jet outlets, basin discharge opening and bottom discharge hole;

FIG. 11 is a cross-sectional perspective view of a preferred self-installable embodiment with separate and/or foldable parts.

DETAILED DESCRIPTION OF THE PREFERRED EMBODIMENTS

Figure 1:
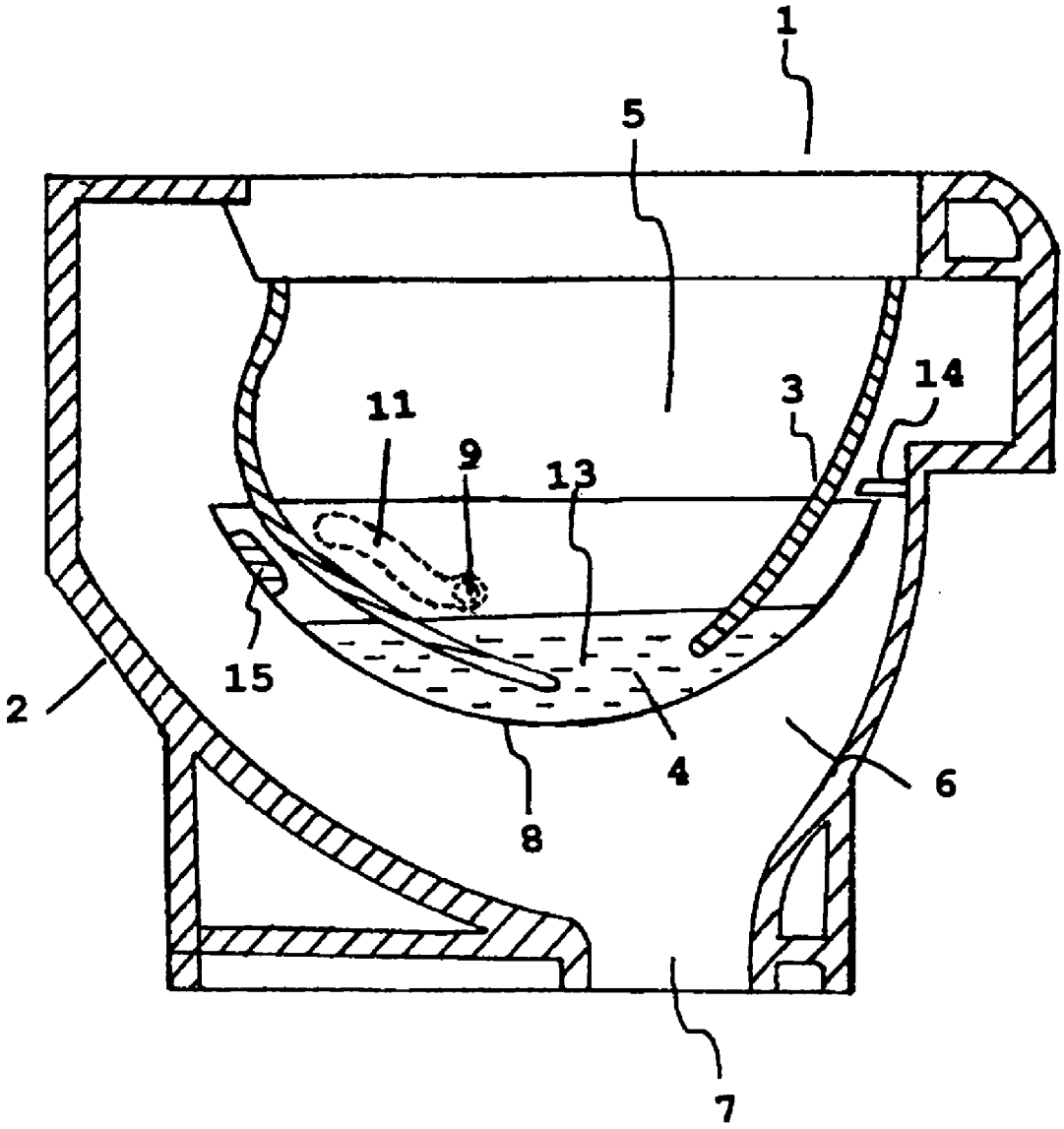
FIG. 1 is a cross-sectional view of a preferred embodiment of the toilet in accordance with the present invention, comprising a tilting bowl.

A preferred embodiment of the toilet in accordance with the present invention is illustrated in FIG. 1, and is generally identified by the reference 1.

Toilet 1 comprises a frame 2 which supports a toilet basin 3 with a basin discharge opening 4 such that basin 3 partitions frame 2 into an upper chamber region 5 and a lower chamber region 6, with discharge opening 4 forming a communication channel between them. Lower chamber region 6 comprises a bottom discharge hole 7 for discharging waste and water to sewage pipes outside the toilet (not shown).

Figure 2:
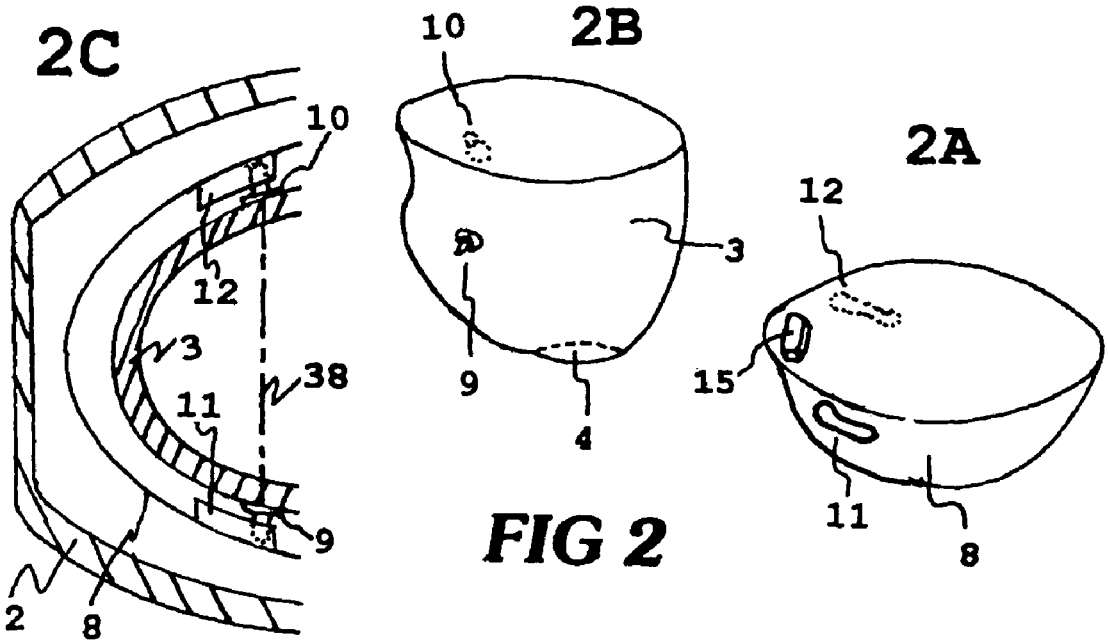
FIG. 2 shows the tilting bowl with grooves fitted to toilet basin studs. The studs form a support axis, and the grooves serve to guide the tilting bowl movement.
Figure 3:
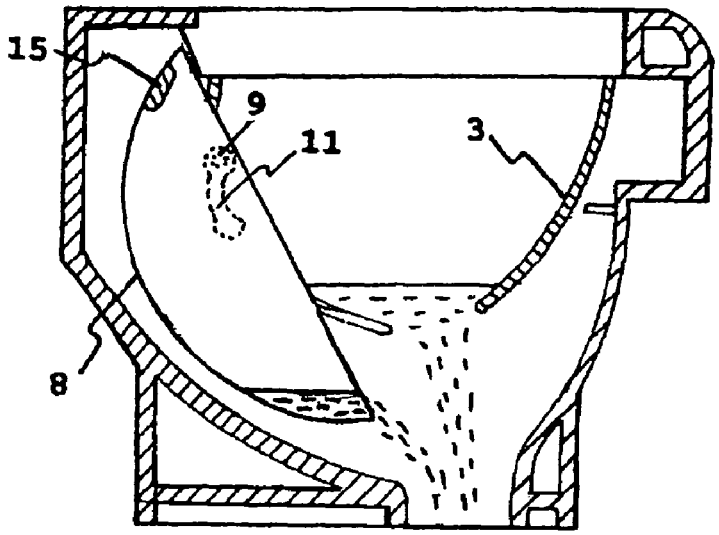
FIG. 3 shows the tilting bowl in tilted position.

Inside lower chamber region 6, a tilting bowl 8 is sustained to stay just below toilet basin 3 in a generally horizontal position during standby, and capable of tilting and moving toward a second location to discharge its content. Tilting bowl 8 comprises grooves 11 and 12, one on each side in generally symmetrically opposite positions as shown in FIG. 2A. The outer wall surface of basin 3 comprises 2 supporting studs 9 and 10 in generally symmetrically opposite positions as shown in FIG. 2B. Studs 9 and 10 fit into grooves 11 and 12, as shown in top-view cross-section diagram FIG. 2C. Thus support studs 9 and 10 form an effective support axis 38 about which tilting bowl 8 can effect tilting movement. At standby, studs 9 and 10 are at the right ends of grooves 11 and 12 respectively. The studs and grooves are so shaped that when tilting bowl 8 starts tilting, the right ends of grooves 11 and 12 begin to loose grip with studs 9 and 10, allowing tilting bowl 8 to move toward a second location with grooves 11 and 12 sliding about studs 9 and 10 respectively. Relatively support axis 38 simultaneously shifts from right ends of the grooves toward left ends of the grooves, as shown in FIG. 3. Hence grooves 11 and 12 serve as relative motion guides for support axis 38, which in turn guides tilting bowl 8 for moving toward the second location and discharging its content.

Since support grooves 11 and 12 are situated on one end of tilting bowl 8, on the left end in this embodiment, in the horizontal standby position, the centre of gravity of bowl 8 together with its water content constitutes a turning moment tending to tilt bowl 8 in clockwise direction. A mass 15 is fixed to the left end of bowl 8 to form a counterclockwise turning moment to stop bowl 8 from tilting, tending to sustain bowl 8 in its horizontal position. Alternatively, bowl 8 may be purposely built with one end significantly heavier, (left end in this embodiment), to eliminate necessity of mass 15. A small block 14 inside toilet frame 2 may also be added to assure bowl 8 not to exceed the generally horizontal position at standby.

In its standby position, bowl 8 encompasses the lower part of basin 3, and contains a standby volume of water 13 to seal off discharge opening 4 to stop sewage gas from passing through. When water is added to the toilet and flow into bowl 8, its content weight increases and hence the clockwise movement turning moment increases. When water content increases to the extent that the movement turning moment exceeds the sustaining moment, bowl 8 starts to tilt and move toward the second position, with grooves 11 and 12 sliding about studs 9 and 10. Relatively support axis 38 shifts from right ends toward left ends of the grooves simultaneously. As the support axis gradually shifts to the left side of bowl 8, the clockwise turning moment increases and the anticlockwise turning moments decrease, thus accelerating bowl 8 tilting to effectively pour its water content to lower chamber 6, to be discharged to sewage through discharge hole 7. The empty bowl 8 will then be pushed back to its standby horizontal position by the sustaining moment from mass 15. In case desired, grooves 11 and 12 may also comprise special return tracks for efficient returning of bowl 8 to standby position. A volume of water will then be added to bowl 8 to seal opening 4 to assure no sewage gas escape at standby.

Alternatively, grooves 18 and 19 may be added on the outer side of bowl 8, as shown in FIG. 4A, to slide along studs 16 and 17 on inside surfaces of frame 2, with an effective support axis 70 constituted along studs 16 and 17, as shown in top view cross-sectional drawing FIG. 4B. For better support and smooth operation, grooves may be added to both inner surface and outer surface of the same bowl 8, with studs on both basin 3 and frame 2 simultaneously. It is of course possible to combine inner grooves with outer grooves to form hollow grooves 73 and 74 through which rods 75 and 76, linking basin 3 and frame 2, constitutes effective support axis 78 to support bowl 8, as shown in FIG. 4C. Alternatively studs may be added to bowl 8, with grooves on basin outer surface and/or frame inner surface. Although studs and grooves are described herewith, other forms of supporting tilting bowl to basin and/or frame for movements are within scope of this invention.

With support studs 9, 10, 16 and 17 replaced by properly shaped magnets and with grooves 11, 12, 18 and 19 made ferrous, or alternatively, both studs and grooves made magnetic, bowl 8 may be sustained in standby position by magnetic force and movement can be made magnetic. Alternatively magnetic fields may also be generated electrically for bowl suspension and bowl movement may also be effected magnetically or electrically.

FIG. 5 illustrates another preferred embodiment with bowl 8 sustained to stay in its standby position by a small tongue 20, at rim of bowl 8, resting on tip 21 of support plank 22, which forms part of a trigger assembly 23. A push on trigger switch 25 forces plank 22 to retreat away from tongue 20, allowing bowl 8 to tilt and move toward the second position. In this embodiment weight mass 24 can be adjusted to only for returning the empty bowl 8 from tilted position back to standby position. Tip 21 is of slant shape at its lower side so that the returning tongue 20 will push plank 22, which is spring-supported, to retreat. Once tongue 20 is above tip 21, plunk 22 will be pushed by internal spring action to protrude again. The incoming standby water volume 13 will press tongue 20 to rest on the flat upper surface of tip 21 again. A preferred trigger assembly is also described in U.S. Pat. No. 6,070,276.

Whilst a mechanical sustaining support with plank 22 and tongue 20 is herewith illustrated, magnets with ferrous parts may be employed for the sustaining support. Magnetic fields generated by electricity may also be employed for tilting bowl suspension and movement. In addition to possible no-contact suspension and minimum tear and wear for movements, electrical operation also enables electronic controls for remote operation, time-controlled operation and/or automatic operation in response to departure of user.

Figure 6:
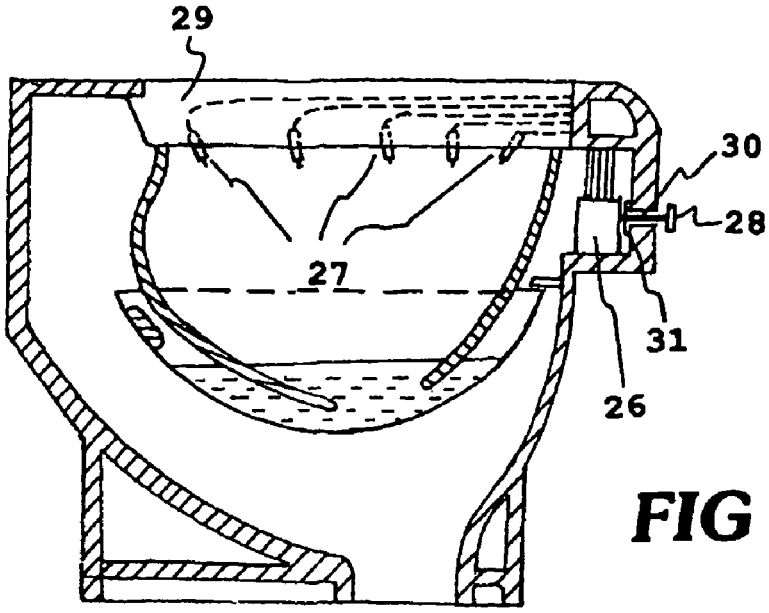
FIG. 6 shows a preferred embodiment with water outlets to supply water for cleaning.

FIG. 6 illustrates another preferred embodiment with automatic water supply. With water valve 26 connected to water mains, a push on trigger switch 28 will start water ejection through water outlets 27 located along inner side of frame rim 29. These water outlets are orientated to achieve optimum cleaning of toilet basin 3. To assure high water pressure cleaning, these outlets preferably should eject water in order of one by one, or pair by pair in sequence, or in any preferred ejection order. Sequential ejection is possible when valve 26 is a sequential valve. A preferred sequential valve is illustrated in Applicant's U.S. Pat. No. 6,070,276. Of course, preferred ejection order includes water ejecting through all outlets simultaneously when water pressure is high.

Figure 7:
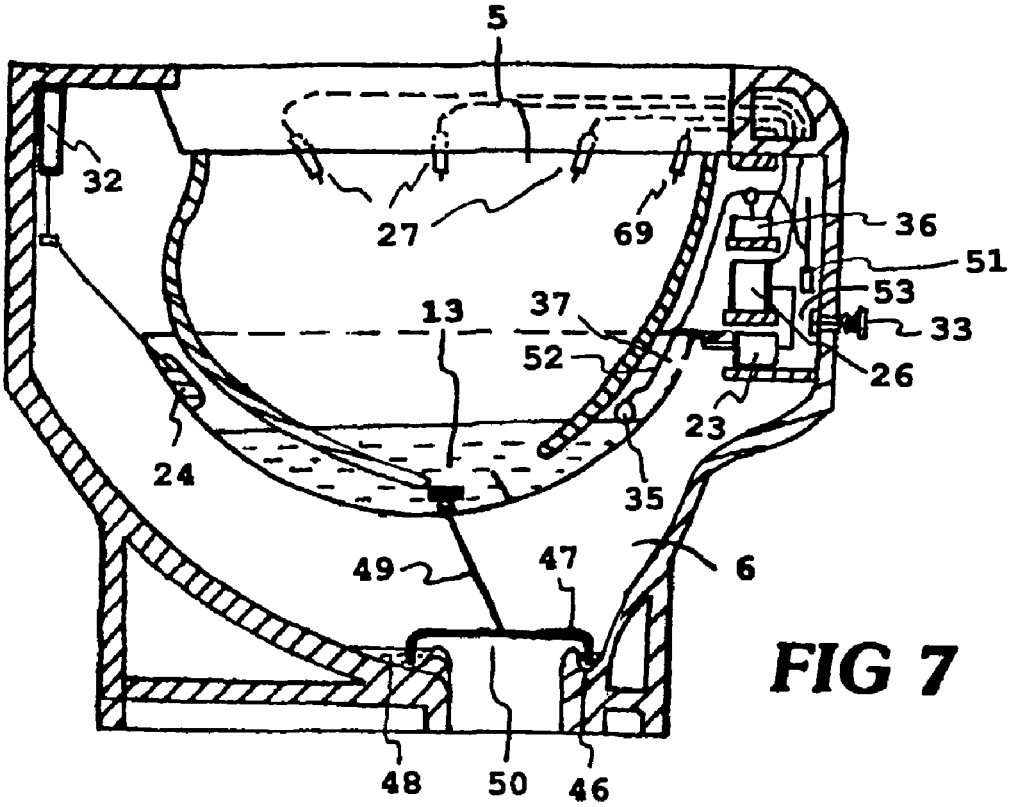
FIG. 7 is a cross-sectional view of a preferred embodiment with start switch capable of actuate both water supply and tilting bowl movement.

Whilst water ejection and bowl tilting may be triggered separately, it is preferably to be triggered by a single switch. FIG. 7 shows a preferred embodiment wherein a push on start switch 33 will trigger both water valve 26 and trigger assembly 23 simultaneously. Start switch 33 goes through a side opening on frame 2. A dynamic O-ring is fitted inside the side opening to assure imperviousness. Start switch 33 as shown here is a simple push-button, but any mechanism serving the purpose, e.g. a lever handle, a rotational device etc. may be used, and are within scope of present invention.

Water ejection starts immediately upon triggering. Retreat of plank 22 may also start immediately, or preferably, may also be delayed by a predetermined time interval to allow thorough cleaning. A trigger assembly with time delay is illustrated also in U.S. Pat. No. 6,070,276. Alternatively, to achieve further water saving, it is also possible for immediate bowl movement to discharge its content prior to delivery of cleaning water.

In addition to capability of manual triggering, tilting bowl toilet operation may also be electrically or electronically triggered. This enables remote triggering to assure a clean toilet prior to entering toilet room. This also enables automatic toilet cleaning upon detection of user departure. Electrical control also enables preset timing for automatic periodic cleaning of public toilets.

To assure sufficient time for basin cleaning, bowl 8 can be retarded to slowly return to its horizontal standby position with mass 24 connected to retarding means 32. In this way, the time interval for return of bowl 8 is determined by retarding means 32, for best cleaning of toilet basin 3. A preferred retarding means is described also in Applicant's granted U.S. Pat. No. 5,802,627.

To assure a gas-sealing water volume 13 at standby, a float 35 can be added, which, when water is below desired level, will trigger to supply water from individual valve 36, through an individual water outlet 69. When water level reaches or is above that of water volume 13, float 35 stops valve 36 operation. On the other hand, whenever water level is too high, excessive water will be discharged through side opening 37 on tilting bowl 8, as shown in FIG. 7. Whilst this embodiment is incorporated with both means, to raise low water level and to discharge excess water, either means may be used individually in other embodiments as preferred.

FIG. 8 illustrates another preferred embodiment that assures bowl 8 movement is triggered at an optimum water level. V-shaped element 39 with a latch 40 on its outer tip and a float 41 on its inner tip is hinged to upper end of bowl 8 for pivoting movement, as shown. At standby, float 41 stays above initial water level 42, and latch 40 is pressed onto block 44 of frame 2 to prevent bowl 8 from moving clockwise. With addition of water, after water level reaches float 41, float 41 begins to rise with further rise of water level. The pivoting of element 39 gradually retreats latch 40 away from block 44 simultaneously. When optimum water level 43 is reached, latch 40 leaves no more contact with block 44, allowing bowl 8 to start moving. Then turning moment by mass 45 returns the empty bowl 8 back to its standby position. With a slanting underside, latch 40 easily pass block 44. Once back to under block 44, the upper flat surface of latch 44 is pressed onto block 44 again by weight of element 39.

As shown in FIG. 7, to restrict sewage gas from entering lower chamber region 6, a liquid seal 50 is formed with a circular groove 46 encircling bottom discharge hole 7 and a circular cover 47 with diameter matching that of circular groove 46. The rim of cover 47 totally dips into water 48 retained in groove 46, thus forming a complete liquid seal to restrict gas from passing through. Cover 47 is connected to bowl 8 by a connecting element 49 with a ring-joint. When bowl 8 tilts, cover 47 is simultaneously lifted up to render bottom discharge hole 7 open. It is of course possible to use dry seals for seal 50, e.g. rubber seals, without deviating from scope of this invention.

It would be desirable not to allow trigger switch 33 to be triggered during toilet operation. To achieve this, as shown in FIG. 7, a blocking metal plate 51 is included into float mechanism 52 linked with float 35 so that the water level control system also serves to disable triggering when water level in tilting bowl 8 is below standby level. When water level falls below standby level, float 35 falls, float mechanism 52 also falls, bringing down metal plate 51 to block passage 53 through which start switch 33 would pass, making triggering impossible. After bowl 8 has returned to standby, and as water level increases, float 35 rises and metal plate 51 goes up. When standby water level is reached, blocking metal plate 51 will be out of passage 53 where start switch 33 travels, and triggering becomes possible again. Whilst a blocking plate is herewith described, it is to be understood that other forms to disable triggering toilet operation during operation can be used and are within scope of present invention.

For those skilled in the art, tilting bowl toilet operation may be easily designed to be jointly or separately triggered by electrical means, or pneumatically or hydraulically driven. Bowl 8 may also be sustained to stay in its first position by different kinds of forces, including but not limited to, gravity force, electrical force, electromagnetic force, magnetic force, pneumatic force, hydraulic force, and/or spring force, in any suitable combination, by modification to the preferred embodiments.

In cases preferred, e.g. for economical embodiments without level control, a dry gas seal can be incorporated between tilting bowl and toilet basin to prevent sewage gas from escaping through basin discharge opening 4, as shown in FIG. 9. In this embodiment, toilet basin 71 is shaped to match curvature of rim 55 of tilting bowl 72 at standby horizontal position. A rubber lining 54 can also be added along rim 55 for impervious joint as shown. Of course, as preferred, a dry gas seal may also be added as an additional safeguard to water volume 13 sealing in all embodiments.

Since there is no zigzag water trap, it is possible for this invention to locate basin discharge opening 4 directly above bottom discharge hole 7 and connect bottom discharge hole 7 directly to sewage pipes which are normally just a short distance from a wall. Thus, when bowl 8 tilts to discharge, waste water can be directly poured into sewage outlets, resulting in minimum blocking chance, and requires minimum water to carry away waste. In fact, in this invention, region 56 encircled by array of water outlets 27, the basin discharge opening 4, and the bottom discharge hole 7 may be made concentric, as in FIG. 10, or preferably, with vertical views of projection overlapping one another. In cases preferred, basin discharge opening 4 may consist of more than one opening to facilitate easier discharge of waste.

FIG. 11 shows another preferred embodiment comprising separate parts of individual frame, individual tilting bowl, individual basin and toilet rim for user assembly. Frame 57, basin 58 and toilet rim 59 each comprises matching flange 60, 61 and 62 respectively, with matching screw holes 63 suitably located as shown. A user can then assemble the toilet by fixing the separate parts together with screws 64 and nuts 65. The advantage of this embodiment is that separate toilet parts, including fixing accessories, can be packed into a compact package, making the toilet portable.

By making the separate parts foldable, the package volume can be further minimized. Thus, when made with flexible materials like nylon or thick PVC, tilting bowl 66 can be designed to be foldable. Frame 57 can also be replaced by a foldable skeleton support 67, with matching screw holes 63, and a matching PVC envelope 68, also with matching screw holes 63, as shown in FIGS. 11A & 11B. With these foldable parts, all toilet components, including mounting and fixing accessories can be packed inside a hand-carrying case. For use as portable toilets, where tap water may not be available, it is desirable that foldable water storage container be included. Of course, for easy disposal of waste, foldable waste containers may also be included.

Whilst features of present invention are described with reference to preferred embodiments, it is herewith reiterated that these embodiments can be modified at will, within scope of the appended claims, without departing from spirit and nature of subject invention.

What are claimed are:

1. A toilet comprising:

a frame defining a chamber, a toilet basin associated with said frame to define said chamber into an upper chamber region and a lower chamber region, said toilet basin defining at least one basin discharge opening in communication between said upper chamber region and said lower chamber region, a tilting bowl disposed generally in said lower chamber region, said tilting bowl defining a fluid-receiving volume, said tilting bowl mounted for pivoting movement relative to said toilet basin between a substantially horizontal first position to receive and hold fluid communicated through said at least one basin discharge opening, and a second position permitting flow of fluid from said toilet basin, through said at least one basin discharge opening, and from said fluid-receiving volume into said lower chamber region, wherein said tilting bowl is sustained to remain in said first position by forces applied to said tilting bowl producing a sustaining turning moment about an effective support axis at least sufficient to counterbalance the turning moment produced by said tilting bowl with its content, said tilting bowl moves from said first position toward said second position when said sustaining turning moment is smaller than said turning moment produced by said tilting bowl with its content, and after said tilting bowl starts moving, said support axis shifts along a relative motion guide to decrease said sustaining turning moment to accelerate said tilting bowl movement to effectively discharge its content to said lower chamber region.

2. The toilet of claim 1 further comprising triggering means to reduce said sustaining turning moment to start tilting bowl movement.

3. The toilet of claim 1 further comprising means to actuate said tilting bowl movement at an optimum fluid level of said fluid receiving volume.

4. The toilet of claim 1, wherein said fluid-receiving volume, in said first position, at least partially overlaps said toilet basin, and retains a volume of fluid sufficient to seal said at least one basin discharge opening to restrict flow of gas therethrough.

5. The toilet of claim 1, wherein said tilting bowl in said first position constitutes an impervious joint with said toilet basin to restrict flow of gas between said lower chamber region and said fluid-receiving volume.

6. The toilet of claim 1, further comprising means to restrict sewage gas from entering said lower chamber region.

7. The toilet of claim 1, further comprising means for delivering water through a plurality of outlets disposed and arrayed to direct water against said toilet basin for cleaning action.

8. The toilet of claim 1, further comprising means for maintaining a predetermined fluid level in said fluid-receiving volume, with said tilting bowl disposed in said first position, said level maintaining means triggering delivery of water when a fluid level below said predetermined fluid level is detected and stopping delivery of water when a fluid level at least equal to said predetermined fluid level is detected.

9. The toilet of claim 1, further comprising means to discharge excessive fluid when fluid level in said fluid-receiving volume exceeds a predetermined level.

10. The toilet of claim 7, wherein delivery of water to said plurality of outlets and movement of said tilting bowl from said first position toward said second position start simultaneously.

11. The toilet of claim 7, wherein delivery of water to said plurality of outlets and movement of said tilting bowl from said first position toward said second position start at different time intervals.

12. The toilet of claim 7 further comprising means to disable actuation when said toilet is operating.

13. The toilet of claim 12, wherein said means to disable actuation is controlled by fluid level in said fluid-receiving volume.

14. The toilet of claim 1, wherein said toilet is adapted for manual actuation, and/or electronic actuation, and/or remote actuation, and/or automatic actuation in response to departure of user.

15. The toilet of claim 1, wherein said forces applied to said tilting bowl comprise constituents of gravity force and/or magnetic force and/or pneumatic force and/or hydraulic force and/or spring force and/or electrical force and/or electromagnetic force.

16. The toilet of claim 1, wherein said tilting bowl is biased to return from said second position toward said first position.

17. The toilet of claim 16 further comprising retard means to retard said tilting bowl from returning from said second position toward said first position.

18. The toilet of claim 1, wherein said at least one basin discharge opening is disposed generally above a bottom discharge hole and with a vertical projection view at least partially overlapping a vertical projection view of said bottom discharge hole.

19. The toilet of claim 7, wherein said plurality of outlets are arrayed to define an enclosure region disposed generally above said at least one basin discharge opening and said bottom discharge hole, said enclosure region casting a vertical projection view at least partially overlapping a vertical projection view of said at least one basin discharge opening and/or at least partially overlapping a vertical projection view of said bottom discharge hole.

20. The toilet of claim 1, in separate parts comprising separate and/or foldable frame, separate and/or foldable toilet basin, separate and/or foldable tilting bowl, separate and/or foldable water storage container, and/or separate and/or foldable waste container.

* * * * *